US007303453B1

(12) United States Patent
Bourke

(10) Patent No.: US 7,303,453 B1
(45) Date of Patent: Dec. 4, 2007

(54) COLLAPSIBLE INFLATABLE DIVE BUOY

(76) Inventor: Vincent Bourke, P.O. Box 14183, Gainesville, FL (US) 32604

( * ) Notice: Subject to any disclaimer, the term of this patent is extended or adjusted under 35 U.S.C. 154(b) by 62 days.

(21) Appl. No.: 11/387,392

(22) Filed: Mar. 23, 2006

(51) Int. Cl.
*B63B 22/16* (2006.01)
*B63B 22/22* (2006.01)

(52) U.S. Cl. ..... 441/6; 441/30

(58) Field of Classification Search ..... 441/1, 441/6, 11, 28, 30
See application file for complete search history.

(56) References Cited

U.S. PATENT DOCUMENTS

| | | | | |
|---|---|---|---|---|
| 3,425,390 | A * | 2/1969 | Isaac | 116/210 |
| 4,123,813 | A | 11/1978 | Adams | |
| 4,144,606 | A | 3/1979 | McIntyre | |
| 4,675,686 | A | 6/1987 | Robinson et al. | |
| 4,796,553 | A | 1/1989 | Cogswell et al. | |
| 5,141,458 | A | 8/1992 | Church | |
| 5,179,907 | A | 1/1993 | Galbraith | |
| 5,329,873 | A | 7/1994 | Tiballi | |
| 5,516,316 | A | 5/1996 | Rumminger | |
| 5,687,664 | A | 11/1997 | Sofian | |
| 5,735,719 | A | 4/1998 | Berg | |
| 6,162,106 | A | 12/2000 | Shieh | |
| 6,200,026 | B1 | 3/2001 | Carmichael | |
| 6,273,773 | B1 | 8/2001 | Bourke | |
| 6,652,339 | B1 | 11/2003 | Carmichael | |
| 6,860,773 | B2 | 3/2005 | Carmichael | |

FOREIGN PATENT DOCUMENTS

| | | | |
|---|---|---|---|
| GB | 2039120 | A * | 7/1980 |

* cited by examiner

*Primary Examiner*—Jesús D. Soleto
(74) *Attorney, Agent, or Firm*—Sven W. Hanson

(57) ABSTRACT

An inflatable dive float is provided with a supported flag that is collapsible to a small size for ease of handling and storage. The dive float includes a novel buoyancy element formed of a durable flexible cover and lightweight replaceable bladder provided by a conventional balloon. The cover is configured to allow easy replacement of the bladder. A collapsible frame internal to the cover provides rigid support for a flag pole and connection to a rigid counterweight staff. The internal frame element is held in place, during use, by the pressure of the inflated bladder. Deflation of the bladder allows collapsing of the frame element and the cover which provides a greatly reduced geometry for storage and handling after use. Both the flag pole and counterweight staff are preferably collapsible as well to reduce storage dimensions.

11 Claims, 3 Drawing Sheets

COLLAPSIBLE INFLATABLE DIVE BUOY

BACKGROUND OF THE INVENTION

The present invention pertains to personal dive buoys and like open water surface markers. In particular, the invention regards inflatable dive buoys that are collapsible when not in use to provide a small size for ease of storage and portability.

Recreational diving, both with and without specialized underwater breathing equipment, is a sport found throughout the world and in most every body of water. When diving in open waters, such as with SCUBA equipment, a diver generally marks his location by use of a floating marker or buoy. This is a safety precaution to assure that any approaching boats do not overrun the diver. Many areas require, by statute or local regulation, that all divers be accompanied by a "diver down" flag visible above the water's surface. This is typically supported from a dive boat or a floating buoy or raft.

Various signal or flag-supporting dive floats and buoys are taught in the prior art as represented by U.S. Pat. No. 5,516,316 to Rumminger; No. 5,735,719 to Berg; No. 4,144,606 to McIntyre; No. 4,123,813 to Adams; and 6,273,773 to Bourke. One difficulty that any dive buoy design must address is the problem of supporting a flag in an upright orientation. Due both the inherent weight and height of any usefully sized flag, there is a tendency for a flag to fall over, either by distorting its base, or overturning its base. This problem is heightened in the presence of any but the lightest wind. This problem is addressed in prior designs in primarily two ways: 1) with a wide base support structure together with a rigid flag pole connection, or 2) by a below-surface counterweight. Retaining a flag pole in an upright orientation may be made easier by use of a rigid float as the buoyancy element. However, a rigid float is inconvenient for handling and storing before and after use, due to both its rigidity, and its inherently larger than convenient size. Several prior dive floats rely on a counterweight or anchor with minimal flagpole base support, such as the device of Rumminger (see above) on which a flag is mounted on the top of an inflated body. However, such a design is too easily overturned in the lightest wind. A design that provides good flag support is that taught in the Adams patent, which uses an inflatable annular float with a center flag support. However, the Adams design, and most inflatable buoys, are susceptible to damage and failure from puncture of the float. Once the float skin is punctured the entire device is disabled and lost for use.

An additional design issue with dive buoys is the need and desire to reduce their handling and storage size. Recreational diving with SCUBA equipment requires a large number and volume of specialized equipment. Transportation of this equipment is a burden that reduces the enjoyment of the sport for many people. Reflecting this, specialized gear bags have evolved to storage and transport personal diving equipment. There is a need to provide equipment that requires a minimum of space to reduce the equipment handling effort. Most dive floats available today are too bulky and add greatly to a diver's equipment burden. Most compact and easily stored dive floats rely on inflatable float elements that are not durable and therefore unreliable. What is needed is an improved dive float including a diver-down flag that is both durable and collapsible for easy handling and storage.

SUMMARY OF THE INVENTION

The present invention is an inflatable dive float with a supported flag that is collapsible to a small size for ease of handling and storage. The dive float includes a novel buoyancy element formed of a durable flexible cover and lightweight replaceable bladder. The cover is configured to allow easy replacement of the bladder. Due to the protection of the durable cover and the ease of replacement, the bladder may be provided by a conventional and easily obtained balloon. A collapsible frame element internal to the cover provides rigid support for a flag pole and connection to a rigid counterweight staff. The internal frame element is held in place, during use, by the pressure of the inflated bladder. Deflation of the bladder allows collapsing of the frame element and the cover which provides a greatly reduced geometry for storage and handling after use. Both the flag pole and counterweight staff are preferably collapsible as well to reduce storage dimensions.

In a preferred embodiment, buoyancy is provided by a spherical cover formed of thin flexible plastic, mesh or fabric cloth. The collapsible frame consists of a single curved frame arm extending between and rigidly supporting a flag pole and counterweight staff. The frame arm hinges at its middle to enable collapse of the arm and float. The frame arm is supported, in use, between the cover and an inflated internal bladder by the pressure of the bladder against the cover. A typical entertainment "party" balloon provides the bladder. The flag pole and counterweight staff are both removeable and collapsible. The entire dive float and flag are configured to collapse to a maximum linear dimension of less than 8 inches for convenience of storage.

The invention includes a dive float kit including a number of replaceable balloons to be inserted into the cover before use as bladders. Additional novel aspects and benefits of the invention will be discerned from the following description of particular embodiments and the accompanying figures.

DESCRIPTION OF THE PREFERRED EMBODIMENTS

Figure 1:
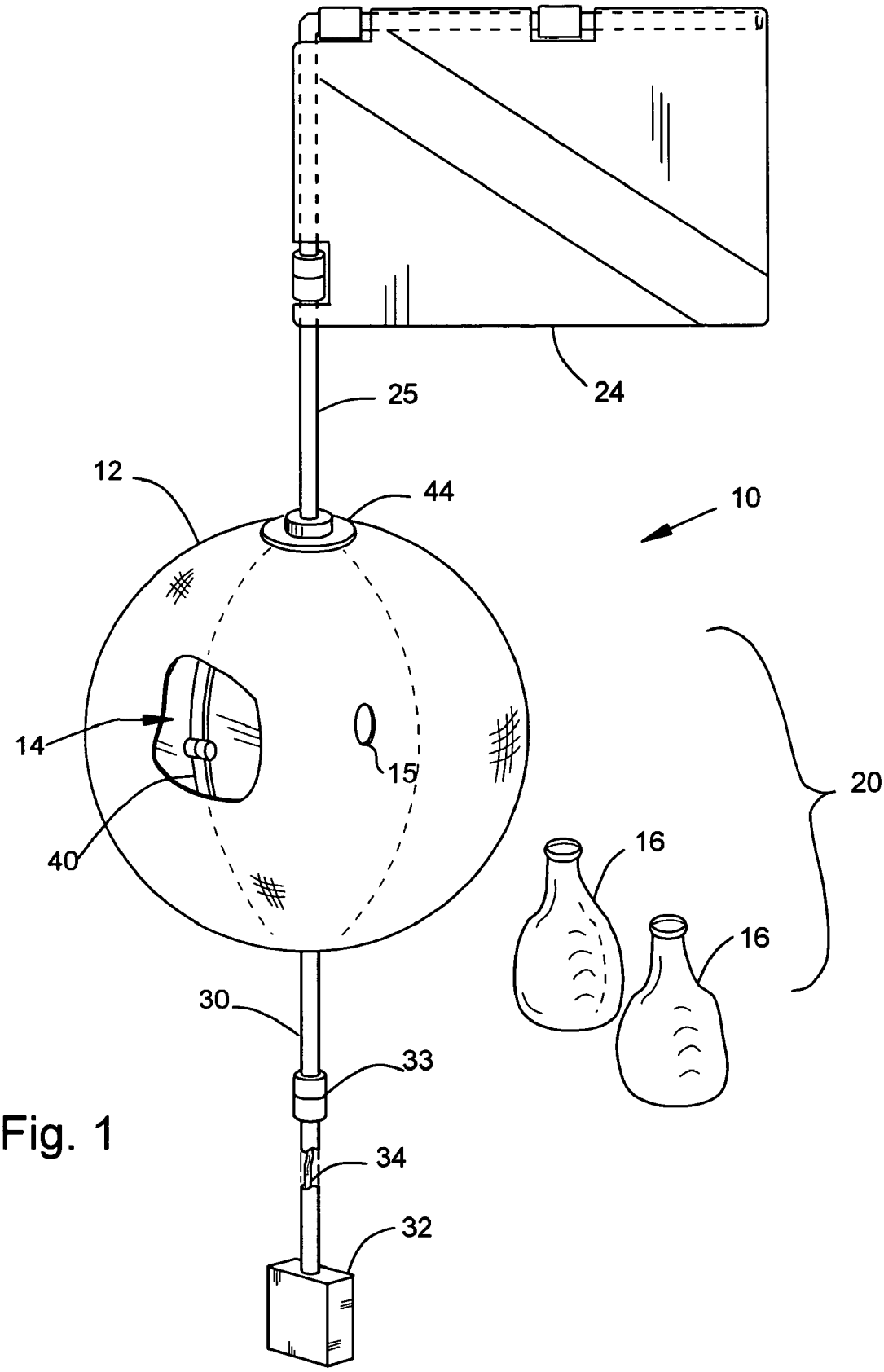
FIG. 1 is a perspective view of a preferred embodiment of the inventive dive float with a flag.

FIG. 1 depicts a preferred embodiment of the inventive dive float. To provide positive buoyancy, a two-part inflatable float body 10 is formed of a durable cover 12 and a replaceable bladder 14. The cover 12 is preferably circular, but may take any generally rounded shape. The cover 14 as shown is formed of durable woven fabric (stitched panels) that is water and moisture permeable. There is no need to use waterproof or airtight material and such is not recommended. In alternative configurations, the cover material may even be a mesh netting so long as the mesh opening size is sufficiently small that the cover is closed to passage of the bladder through the mesh. The cover 12 has an aperture 15 formed as a narrow slit, but is otherwise substantially closed such as to form an inner cavity ensuring retention of the bladder 14. The slit functions to allow insertion and removal of the bladder 14. The aperture 15 is preferably about one to 1.5 inches in length and orientation is not critical. The aperture 15 is preferably strengthened about its perimeter to prevent tearing. In a fabric cover, this strengthening may be accomplished by over-stitching in the manner of a garment buttonhole. The size of the float body is dependent on the size and weight of the elements to be supported. For a typical dive float an effective internal volume for flotation air in the range of 500 to 600 cubic inches is suggested; for a buoyant force of approximately 19 to 20 pounds. For a generally spherical float body this corresponds to a nominal diameter of about 10 (ten) inches.

To retain flotation air a thin, lightweight bladder 14 is used inside the cover 12. The present design is intended to benefit from the low cost and ready availability of novelty balloons and the like that are typically formed of thin latex rubber or similar elastic materials. Because a dive float is typically used for short time periods, an extremely low air loss bladder is not necessary. Similarly, because high pressure is not needed, a balloon that is filled by mouth using a person's breath force is sufficient. As a consequence, the use of a balloon bladder is adequate and therefore beneficial for its low cost.

An additional benefit of using a balloon bladder is that it may be easily and cheaply replaced in case of loss, puncture or deterioration from environmental conditions. To reflect this aspect of the invention, FIG. 1 includes multiple replacement balloons 16 to form, with the dive float, a float kit 20. In use, a new balloon 16 may be inserted prior to each dive event. A deflated balloon 16 is tucked into the cover 12, through the aperture 15, while retaining the neck and mouth of the balloon 16 outside (see FIG. 3). The balloon 16 (now acting as a bladder) is inflated by manually breathing into the balloon until snugly inflated to expand and fill the inside of the cover 12. The balloon's typical narrowed neck 17 is then twisted tightly several times and inserted through the aperture 15 and manually placed between the inflated body of the balloon and the inside of the cover 12 adjacent the aperture 15. The pressure of the balloon against the cover 12 will be sufficient to hold the balloon neck 17 secure and thereby prevent release of air. To accomplish this, the balloon must be sufficiently thin. Other inflatable bladder bodies having, in contrast, a thick-walled body will not be capable of being inserted into the cover 12 and inflated in the manner described here. The balloon 16 may be of any size capable of being inflated to fully fill the corresponding cover 12 while maintaining sufficient inflated wall thickness. Balloons that meet these requirements are generally available from a variety of sources—sold as entertainment "party" balloons that are formed of latex rubber, and having a typical inflated size of 18 to 24 inches nominal diameter. The particular shape of the balloon 16 is not critical if large enough to fill the cover 12 at less than the balloon's maximum volume.

While the low pressure air of the bladder 14 within the cover 12 is sufficient to provide proper buoyancy, a cover 12 so filled is not sufficiently rigid by itself, to properly support an extended dive signal device. The dive float of FIG. 1 includes a dive flag 24 supported on an elongated flag pole 25. At the opposite end of the dive float has an attached rigid staff 30 connecting a counterweight 32. A rigid internal frame 40 is provided within the cover 12 to link the flagpole 25 and counterweight staff 30 to provide a stable base to support the flagpole 25 and flag 24 in an upright orientation.

Figure 2:
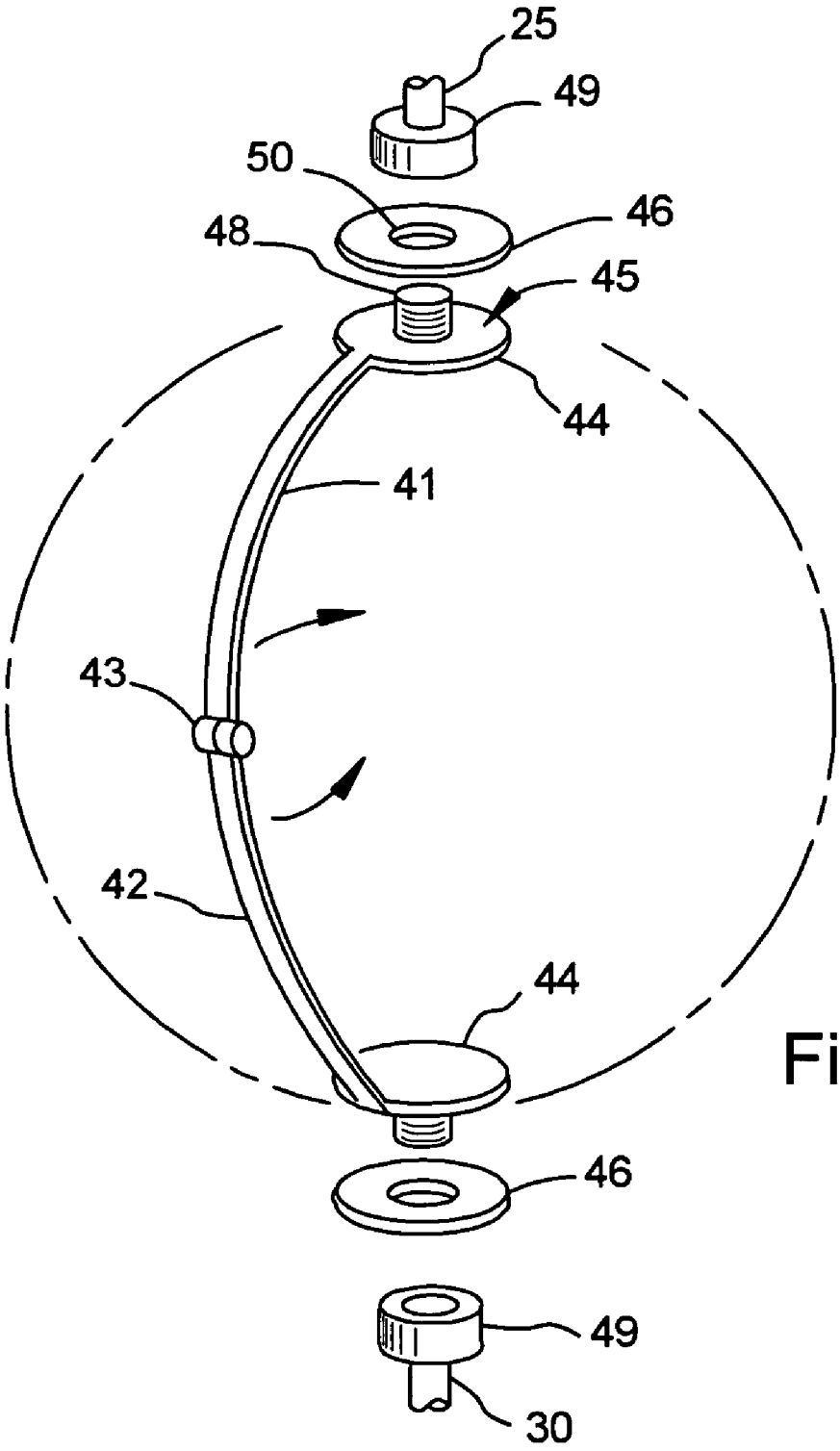
FIG. 2 is a perspective detail view of an inventive internal frame structure for connecting a flag pole to a counterweight staff to provide support for the flag pole.

FIG. 2 provides additional details of the internal frame 40 shown in the same orientation as within the inflated dive float. The internal frame 40 includes two frame arms portion, an upper arm portion 41 and lower arm portion 42 which are joined by a collapsible joint provided by a hinge 43. The upper end of the upper arm portion 41 terminates in an enlarged support pad 44 having an upper face surface 45. The face surface 45 bears against the inside surface of the cover 12. A capture plate 46 is configured to mate with the face surface 45 to capture the cover 12 there. A means of securing the capture plate 46 tightly against the face surface 45 and support pad 44 is provided by a vertical post 48 extending from the center of the support pad 44. The vertical post 48 includes external threads to engage a securing nut 49 having mating internal threads. The capture plate 46 includes a center hole 50 sized to allow the vertical post to pass with clearance; a tight fit is not necessary.

Figure 3:
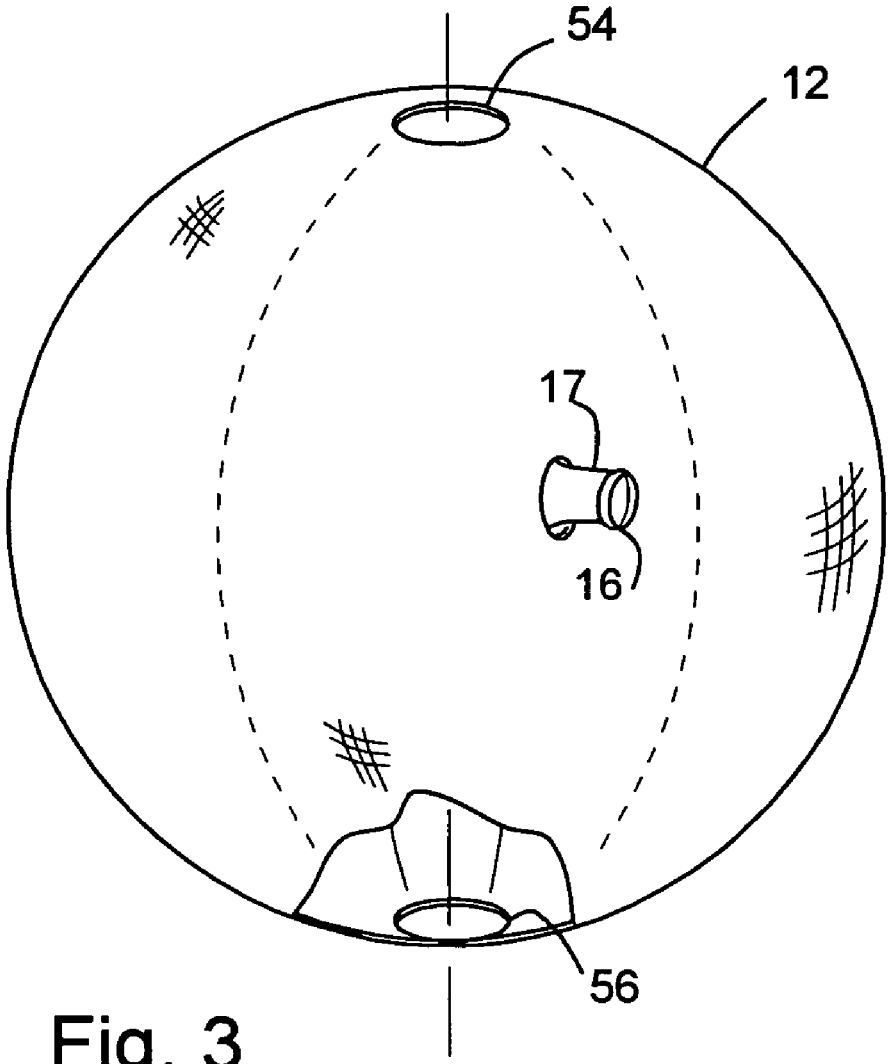
FIG. 3 is a perspective view of a float cover according to the invention.

In assembly of the dive float, the internal frame 40 in located inside the cover (for clarity not shown in FIG. 2) and the vertical post 48 passed through an upper hole 54 in the cover (see FIG. 3). The upper hole is approximately the diameter of the vertical post 48 such that the vertical post 48 easily passes through but the larger support pad 44 is retained within the cover 12. Upon placing the capture plate 46 over the vertical post 48 and engagement of the securing nut 49 on the vertical post 48, the cover 12 is effectively captured between the support pad 44 and the capture plate 46. A radial engagement dimension that the cover 12 overlaps the support pad 44 and capture plate 46 of at least two inches is suggested to ensure retention of the cover 12.

The lower arm portion 42 terminates at its lower end with a like structure that captures the cover 12 at the perimeter of a lower hole 56 that is diametrically opposite the upper hole 54. Extending rigidly from the respective securing nuts 49 are the base elements of the flagpole 25 and staff 30. These are shown truncated in FIG. 2 for simplicity.

The frame 40 is rigidly connected to the associated support pads and has sufficient rigidity and strength that, together with the support afforded by the bladder pressure and tension in the cover 12 when inflated, the flagpole 25 and staff 30 are rigidly linked and will not appreciably overturn at their bases during use even in high wind conditions. To maximize the support to the frame 40 from the cover 12 and inflated bladder 14, the frame arm portion 41, 42 are curved to match, and bear against, the inside surface of the cover 12. This configuration minimizes the necessary size and support of the arms themselves such that a single frame arm is sufficient. As well, the support to the frame sufficient to allow the arm portions 41, 42 to be pivotably joined. The arms 41, 42 may be entirely unconnected to the cover 12 itself. This configuration makes the dive float easy to collapse when the bladder is deflated, as the arms' support is thereby released and they are then allowed to fold at the hinge 43. The manner of folding of the arms 41, 42 after deflation is indicated by the movement arrows in FIG. 2. While the frame and interconnection design discussed may be applied to a frame with multiple elements extending between the support pads, more than one is unnecessary and would only detrimentally add to the bulk and size of the device.

For a suggested dive float having a float body of the above suggested size, the following parameters define an acceptable internal frame structure. The support pad outer diameter (or nominal width) is suggested to be in the range of 1.5 to 2 inches. Because of their being partially supported in use by the inflated bladder and therefore somewhat prevented from bending, the arms 41, 42 may be relatively small in cross-section. The arms are suggested to be of flat cross-section having a width of 0.75 to 1 inches and an orthogonal (radial) dimension in the range of 0.125 to 0.25 inches. Other cross-section shapes having similar bending sections are also applicable. Larger, stiffer elements are not necessary and detract from weight and size demands of the invention. The above dimensions are suggested for an internal frame formed of the material polyethylene. Other materials, including, but not limited to other metal alloys and high strength industrial plastics such as nylon or polyvinylchloride (PVC) may also be used; the dimensions may be then adjusted on an equal stiffness basis. Any material used should have corrosion resistant properties and be generally durable.

The support pad 44 and capture plate 46 and the method of engaging the cover 12 and flagpole 25 as shown, is only one example of a structure meeting the functions of the invention. Other support pad configurations that provide a broad area of engagement with cover 12 at the flagpole base and that is rigidly connected to an extended rigid arm between the cover and bladder may provide the same benefit. The capture plate 46 and securing nut 49 may, alternatively take other forms, including being integrated into a single piece. Other devices or structures for joining a broad base support such as the support pad 44 to the cover 12 are contemplated. For example, a support pad may be secured to the inside of the cover by adhesive bonding with a mating capture element and pole base similarly bonded to the outside of the cover. Such a configuration will provide the same result in a cover not having the holes needed for pass-through of the vertical post 48 as discussed above. In yet another alternative, the function of the support pad and capture plate may be combined in a single structure integral with a cover; the support element being essentially a cover area of increased thickness and rigidity. Such a construction may be produced in molded plastic.

FIG. 3 shows the inventive cover 12 with an inserted balloon 16 before inflation with balloon neck 17 protruding. For simplicity, the cover 12 is shown as a sphere, where more likely prior to inflation of the balloon, the cover would be somewhat collapsed and partially folded. FIG. 3 also depicts the relative location of the upper and lower holes 54, 56 through which the vertical post 45 extends as discussed in respect to FIG. 2. The cover 12 is shown partially cut away to view the lower hole 56. In other, non-spherical cover shapes, the upper and lower holes should be generally symmetrically opposing for buoyant balance. In a construction not using holes, such as with a bonded support pad as discussed in the preceding section, the support pads should be located in the manner of the holes 54, 56. The location and orientation of the holes, and support pads, is necessary to result in the flagpole and staff extending, parallel, in opposite directions to provide the most desired balance and attitude of the signal device. This same result may be produced, in alternative configurations, with somewhat offset hole or support pad locations together with compensating base angles for the flagpole or staff.

The flagpole 25 and counterweight staff 30 must be sufficiently stiff and strong to maintain shape under bending load of the associated flag 24 and counterweight 32. Preferably, the flagpole 25 and staff 30 are formed of multiple collapsible subparts to allow reduction to a smaller geometry. The mating ends of each subpart preferably include, and interconnect with, releasable threaded connectors 33 to ensure rigidity during use. Other releasable connectors, such as what are commonly known as "quarter-turn" locking connectors may also be used. For convenience, a multi-part flagpole or staff is suggested to include an internal elastic cord 34 to retain the parts when disassembled (the staff 30 in FIG. 1 is partially cut-away to view the internally located cord 34). Preferably, the maximum element length is no greater than 8 inches to provide the desired disassembled handling and storage benefits. Details of the methods of constructing the flag 24, flagpole 25, counterweight 32 and staff 30 are generally known in other industries such as tent frame construction. A suggested and typical flagpole height is 36 inches to provide sufficient visibility. A suggested staff length (from base to counterweight) and counterweight size to insure proper balance in ocean water are: length of 18 inches and weight of one to 1.5 pounds. Typical weight materials, such as plastic coated lead are suggested.

The embodiment of the figures discussed herein illustrates a generally spherical dive float. This shape is greatly preferred as lending itself well to easily available balloons as a bladder means—such balloons being typically rounded and easily fitting within a spherical cover. However, the novel concepts of the inventive dive float, and the advantages of a dive float with an internal collapsible frame, may be extended to dive floats of other geometries.

FIG. 1 includes a flag 25 as a signal device. However, use of alternative signal devices, such as illuminating beacons or reflectors are also contemplated, mounted in similar fashion on the inventive dive float.

A dive buoy typically includes a line or leash by which a diver user tows the buoy or retains it near the dive location. In the present invention, a leash may be attached in any of a variety of ways. For example, a leash strap may be attached by stitching to the cover 12. Alternatively, a leash may be tied to the counterweight staff 30 or counterweight.

The preceding discussion is provided for example only. Other variations of the claimed inventive concepts will be obvious to those skilled in the art. For example, the concept of a bladder supported collapsible internal frame may be applied to rounded non-spherical shaped floats. Adaptation or incorporation of known alternative devices and materials, present and future is also contemplated. The intended scope of the invention is defined by the following claims.

I claim:

1. A collapsible inflatable personal dive buoy comprising:

a closed flexible cover;

a first and second rigid support pad, each secured, or securable, to opposing points of the cover;

a collapsible rigid internal frame disposed within the cover and rigidly connected to both the first and second support pad;

a first elongated pole secured, or securable, to the first support pad;

a second elongated pole secured, or securable, to the second support pad;

a signal device secured to the first pole;

a counterweight secured to the second pole;

an inflatable bladder configured to fill the cover in an inflated condition;

the cover including an aperture configured to receive and allow the bladder to pass into the cover.

2. A dive buoy according to claim 1, and wherein:

the frame consists of a single arm having a collapsible joint between the first and second support pads and configured to match the shape of the cover and bear against the cover when filled.

3. A dive buoy according to claim 2, and wherein:

the cover has a spherical shape when filled.

4. A dive buoy according to claim 3, and wherein:

the first and second poles each comprise a respective plurality of interconnecting collapsible subparts.

5. A dive buoy according to claim 4, and wherein:

the bladder comprises a latex balloon having a nominal diameter in the range of 18 to 24 inches in an inflated condition.

6. A dive buoy according to claim 1, and wherein:

the cover comprises a woven fabric.

7. A dive buoy according to claim 1, and wherein:

the cover comprises a plastic.

8. A dive buoy according to claim 1, and further comprising:

a first and second capture plate; and wherein:

the cover has two holes orientated on diametrically opposing points of the cover;

each support plate is located inside the cover and aligned with a respective hole, and each capture plate located outside the cover and aligned with a respective hole and secured to the respective support plate to capture, therebetween, the cover at the respective hole;

the first elongated pole secured, or securable, to the first capture plate, and the second elongated pole secured, or securable, to the second capture plate.

9. A dive buoy according to claim 1, and wherein:

the cover has an internal volume, when filled, in the range of 500 to 600 cubic inches.

10. A collapsible inflatable personal dive buoy comprising:

a spherically shaped flexible cover having an internal volume in the range of 500 to 600 cubic inches in an inflated condition and including an aperture having a length dimension in the range of 1 to 1.5 inches;

a first and second round support pad, each having a diameter dimension in the range of 1.5 to 2 inches, and each secured, or securable, to opposing points on the cover;

an internal frame consisting of one rigid arm disposed within the cover and rigidly connected to both the first and second support pad and having a collapsible joint between the first and second pad;

a first elongated pole releasably secured to the first support pad and extending radially outward from the cover;

a second elongated pole releasably secured to the second support pad to extending radially outward from the cover;

a flag secured to the first pole;

a counterweight secured to the second pole;

a balloon disposed within the cover and configured to enable inflation by human breath force while within the cover.

11. A dive buoy according to claim 10, and wherein the first and second poles each comprises a respective plurality of subparts interconnected by releaseable locking joints and elastic cord.

* * * * *